US005377696A

United States Patent [19]

Goldman

[11] Patent Number: 5,377,696

[45] Date of Patent: Jan. 3, 1995

[54] CIGARETTE RECONDITIONING DEVICE

[76] Inventor: Jonathan D. Goldman, 252 Rutgers St., Rochester, N.Y. 14607

[21] Appl. No.: 159,730

[22] Filed: Nov. 30, 1993

[51] Int. Cl.[6] ..... A24F 13/20

[52] U.S. Cl. ..... 131/248; 131/256; 30/92; 30/113

[58] Field of Search ..... 131/248, 250, 256; 30/92, 109, 111, 113

[56] References Cited

U.S. PATENT DOCUMENTS

| | | | |
|---|---|---|---|
| 890,922 | 6/1908 | Pettibone | 131/248 |
| 2,487,131 | 11/1949 | Harris | 206/38 |
| 2,556,478 | 6/1951 | Marbell | 206/38 |
| 2,990,055 | 6/1961 | Hughes | 206/38 |
| 3,888,264 | 6/1975 | Baclit | 131/235 |
| 4,160,318 | 7/1979 | Morel | 131/248 X |

FOREIGN PATENT DOCUMENTS

| | | | |
|---|---|---|---|
| 2390115 | 1/1979 | France | 131/248 |

*Primary Examiner*—Jennifer Bahr

[57] ABSTRACT

A device which makes it possible to smoke the same cigarette several times by cutting and snuffing burning tobacco from the end of the cigarette, leaving a cigarette butt that can be smoked again. The devices uses a blade (24) and a snuffer (26), movable in a housing attachable to a tray (12) to hold a cigarette. The burning end of a cigarette is inserted into an opening in the blade and snuffer housing through which said blade and snuffer are reciprocally movable. Said blade cuts through the cigarette and detaches the burning tobacco from the cigarette, leaving the butt reconditioned for smoking again. Said snuffer is a bar which snuffs the burning tobacco cut from the end of the cigarette by pressing it against a flange (16) of the housing.

7 Claims, 3 Drawing Sheets

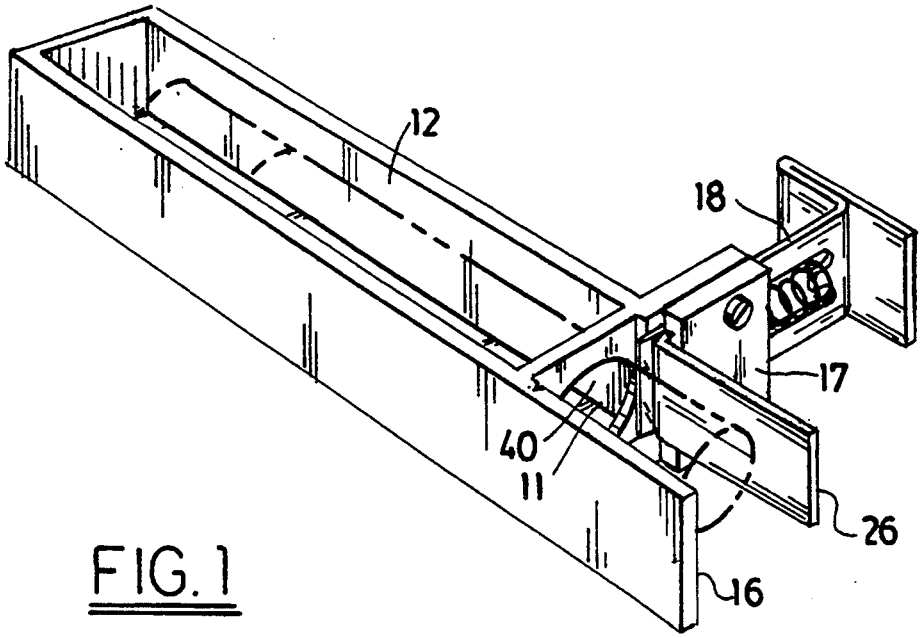
FIG. 1
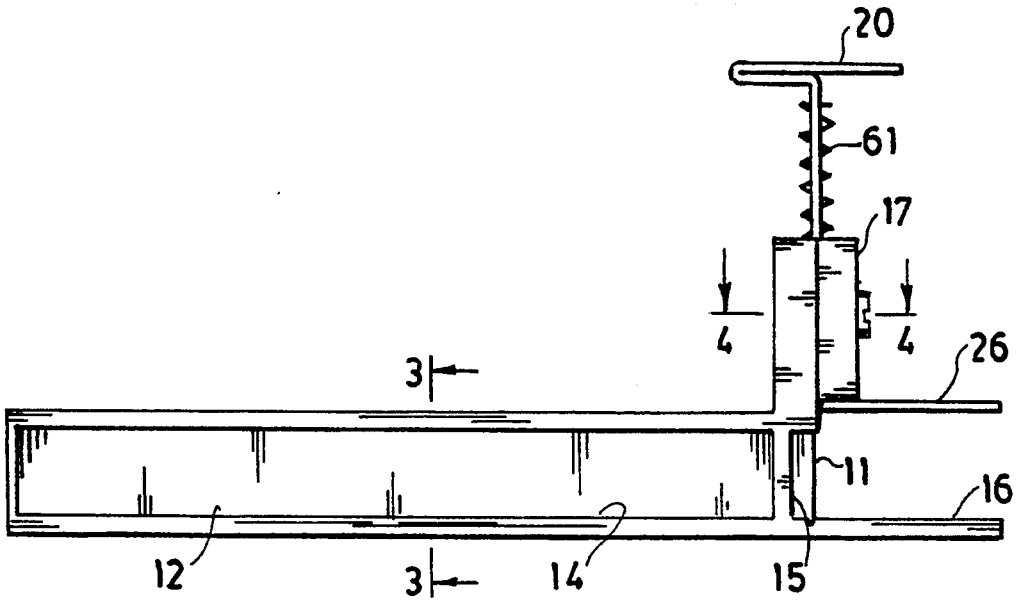
FIG. 2
FIG. 3
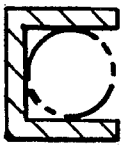
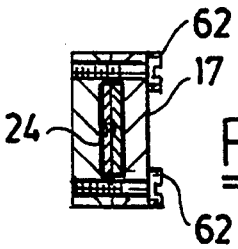
FIG. 4

CIGARETTE RECONDITIONING DEVICE

FIELD OF THE INVENTION

This invention relates to a device which enables a smoker to extinguish recondition a burning, partially-smoked cigarette for the purpose of smoking the cigarette a plurality of times.

BACKGROUND

Cigarette smoking is a habit many smokers try to quit or reduce. There are well-documented health hazards posed by cigarette smoke, including secondary smoke. Also, the cost of the habit constitutes a significant financial burden to the smoker. Government taxes raise this cost further. It is very much in the interest of smokers to reduce both the amount of tobacco and the number of cigarettes they smoke, as well as the amount of secondary smoke they inhale.

One way for smokers to reduce the amount of tobacco smoked is to smoke only part of each cigarette. Many smokers are satisfied with smoking only part of a cigarette, and snuff burning partially-smoked cigarettes by grinding or crushing them against the bottom of a conventional ashtray. Another method of snuffing burning, partially-smoked cigarettes is by depriving the burning tobacco of oxygen. U.S. Pat. No. 2,990,055 to Hughes, 1961 Jun. 27, discloses an addition to cigarette packages which enables a smoker to do this.

Few smokers could or would smoke the partially-smoked cigarette (the "butt") that results from the use of either of these methods. Grinding or crushing usually breaks or tears the cigarette, rendering the butt unsmokable. Even if it is not rendered unsmokable, the butt has burnt tobacco at the end; it is visually unappealing and smelly, and pieces of burnt tobacco are prone to breaking off the butt. Also, pieces of burning tobacco are often broken off a cigarette as it its being ground or crushed. As these pieces burn they release smoke into the smoker's environment. The pieces of burning tobacco can ignite butts or other inflammable materials in an ashtray, releasing more smoke.

Depriving a burning cigarette of oxygen also leaves burnt tobacco at the end of the butt, and releases smoke into the invention and eventually the environment until all the oxygen in the snuffing compartment has been consumed.

Both of the aforementioned methods waste the remaining unburnt tobacco and release smoke into the environment.

OBJECTS AND ADVANTAGES

Accordingly, one object and advantage of the present invention is to neatly cut and completely separate the burning tobacco from a cigarette, leaving a butt that is suitable for smoking.

Another object and advantage of the present invention is to immediately and completely snuff the burning tobacco of a cigarette, reducing the amount of smoke released into the smoker's environment.

Another object and advantage of the present invention is to snuff the burning tobacco of a cigarette without breaking or tearing the cigarette, so that it is possible to smoke the butt at a later time. In fact, with the present invention two or more smokes can be derived from a single cigarette.

Other objects and advantages of the present invention will become more apparent from the drawings and detailed description given hereinafter.

BRIEF DESCRIPTION OF DRAWINGS

FIG. 1 is a perspective view of a cigarette reconditioning device, with the blade and snuffer plunger in the retracted position, and a cigarette (outlined) in position for cutting and snuffing.

FIG. 2 is a top view of the device, with the blade and snuffer plunger in the retracted position.

FIG. 3 is a sectional view, taken along the line 3—3 of FIG. 2, of the cigarette holding tray; a cigarette (outlined) is shown in the tray.

FIG. 4 is a sectional view, taken along the line 4—4 of FIG. 2, of the blade and snuffer housing along a vertical plane.

FIG. 7 shows the device with the blade and snuffer plunger in the retracted position and a burning cigarette inserted. FIG. 8 shows the plunger moved to the closed position, cutting, separating and snuffing the burnt tobacco. FIG. 9 shows the blade and snuffer plunger returned to the retracted position, releasing the snuffed tobacco. The cigarette is being removed.

DETAILED DESCRIPTION

Figure 5:
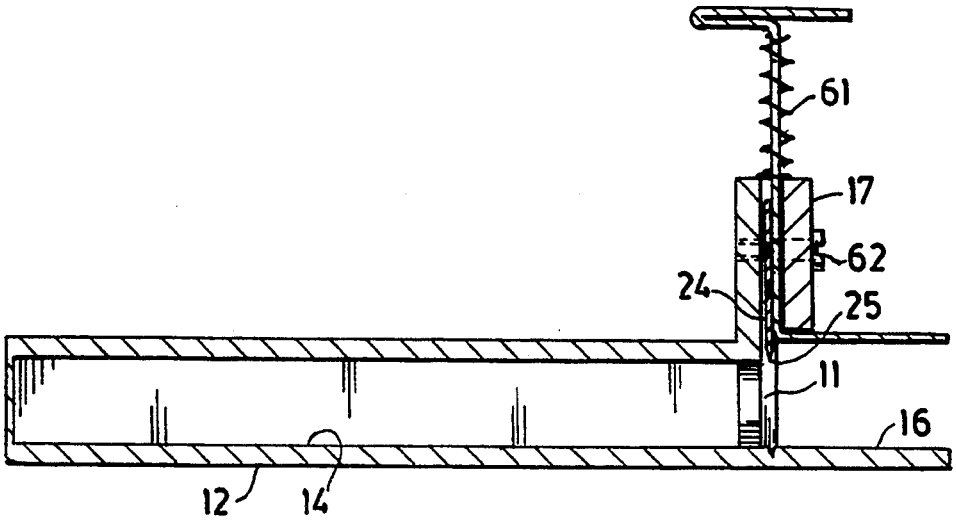
FIG. 5 is a sectional view of the device along a horizontal plane, with the blade and snuffer plunger in the retracted position.
Figure 6:
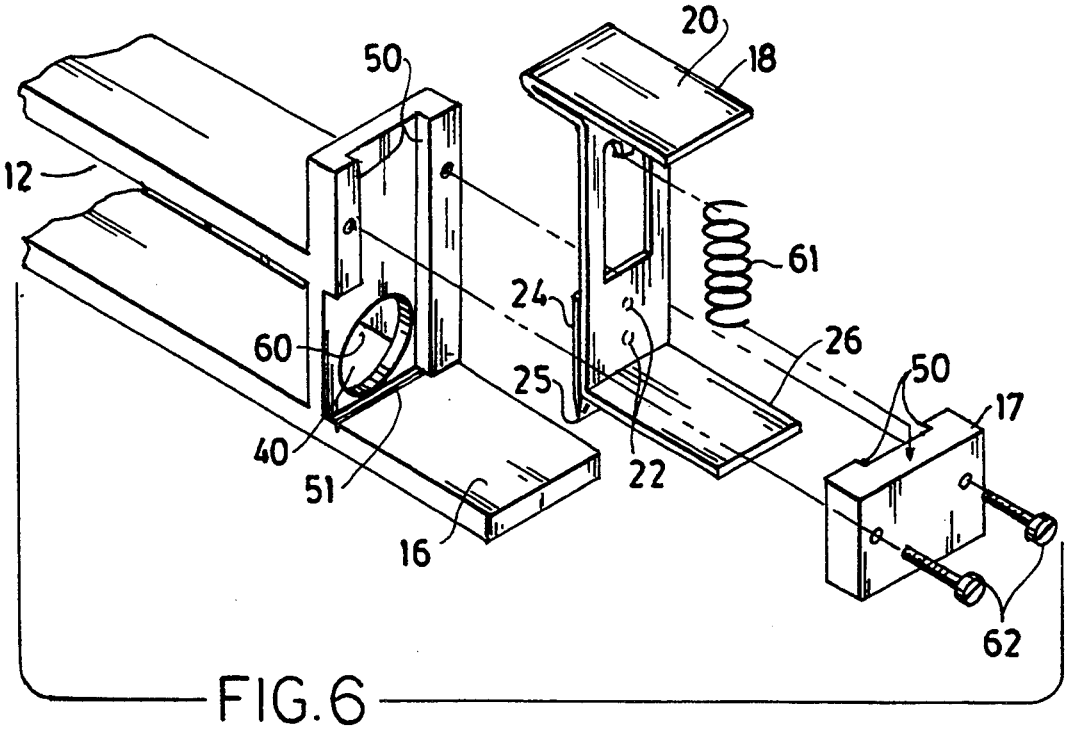
FIG. 6 is an exploded view of the device.

Referring to FIGS. 1–6, various parts are preferably made from thermosetting plastic which is resistant to melting at the temperature of burning tobacco.

It should be understood that the invention is applicable to smoking materials other than cigarettes, such as cigars, cigarillos and the like. Where the term cigarette is used it contemplates such other smoking materials.

The blade and snuffer plunger 18 is illustrated in detail in FIGS. 1, 2, 4, 5, and 6. The blade 24 has a sharp edge 25 at the end farthest from the finger grip 20. The blade and snuffer plunger 18 is a piece of metal that has been bent twice so as to form a finger grip 20 perpendicular to the body of the plunger 18, and once so as to form the snuffer 26, also perpendicular to the plunger 18. The blade 24 is spot-welded at points 22 to the blade and snuffer plunger 18 so that the sharp edge of the blade 25 extends approximately ⅛" from the bend which forms the snuffer 26. This insures that the burning tobacco is snuffed as it is being cut from the cigarette, and reduces the chance and severity of any injury occurring as a result of accidentally sticking a finger into the cigarette insertion hole 40. The plunger 18 and blade 24 define a guillotine for cutting off the burning end of the cigarette.

The blade and snuffer plunger 18 is placed against the blade and snuffer housing front part 10 so that the finger grip 20 extends away from the cigarette insertion hole 40, the spot welds 22 are against the back side of the blade and snuffer housing front part 10, and the snuffer 26 is parallel to a flange extending from the back end (on the right as seen in the FIGS.) of the blade and snuffer housing, the snuffer stop 16. The blade and snuffer housing back part 17 is then placed against the blade and snuffer housing front part 10 so that the snuffer 26 projects from the cutting chamber 11. The blade and snuffer housing front and back parts 10 and 17 are then joined together to form the complete blade and snuffer housing. Screws, snaps, or other fastening means may be used to assemble these parts.

It should be understood that both the spring 61, as a means for biasing the plunger to its retracted position, and the cigarette tray 12, as a means for securing the cigarette during and after cutting, increase the convenience of operation of the device, and are optional.

Figure 7:
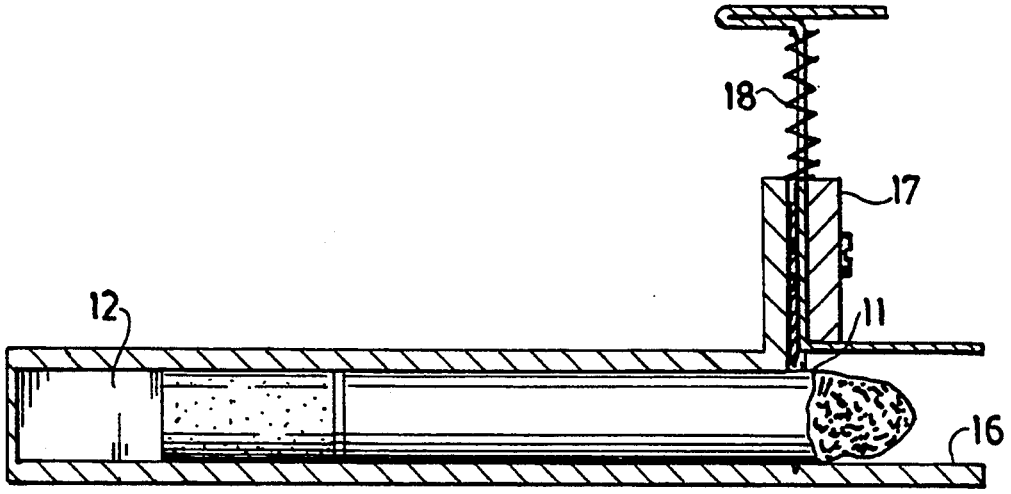
FIGS. 7–9 illustrate the device in different positions during operation, in top-plan, sectional view.
Figure 8:
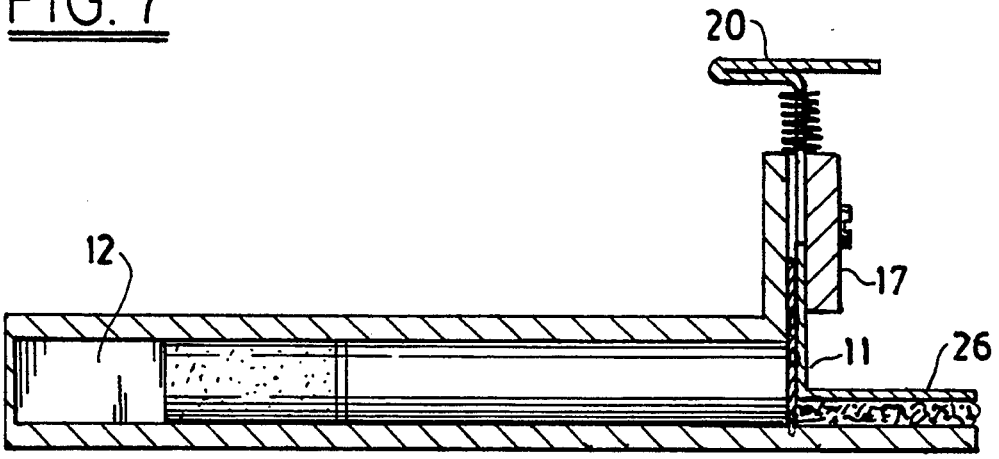
Figure 9:
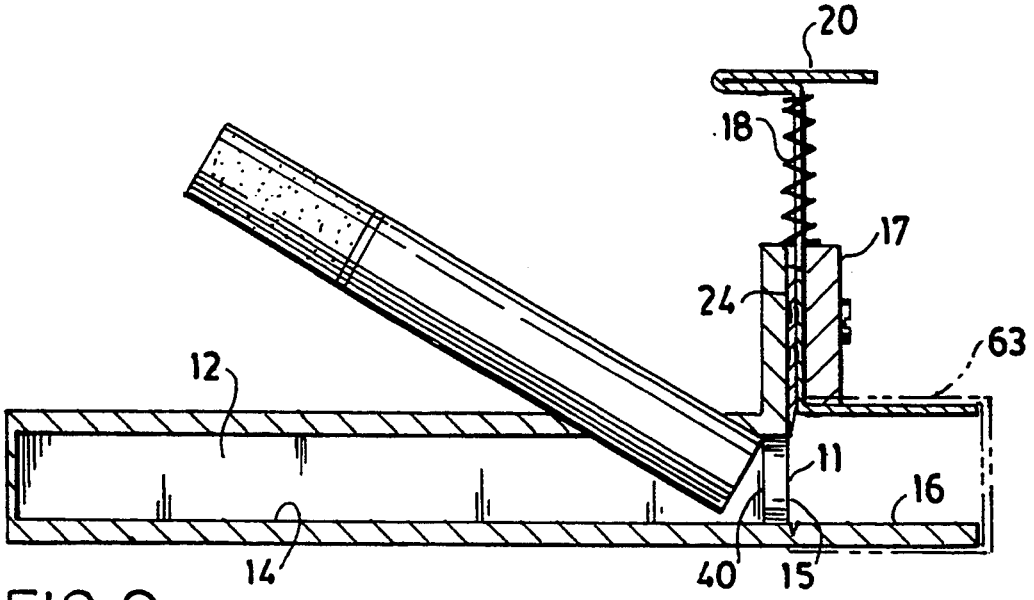

In the preferred embodiment, the blade and snuffer housing front part 10 is attached to the cigarette tray 12 so that the recessed cigarette tray bed 14 lines up with the cigarette insertion hole 40. This insures that sliding a cigarette on the cigarette tray bed 14 will guide it directly to the cigarette insertion hole 40. FIGS. 7–9 show the preferred embodiment of the present invention, with a cigarette tray 12. In operation, FIG. 7 shows the blade and snuffer plunger 18 initially in the retracted position. FIG. 8 shows a cigarette resting on the recessed cigarette tray bed 14, and inserted into the cigarette insertion hole 40 so that all the burning tobacco and a small amount of unburnt tobacco is past the cutting groove guide 15. The smoker then moves tile blade and snuffer plunger 18 to the closed position by squeezing the finger grip 20 and the snuffer stop 16 side of the blade and snuffer housing. The blade sharp edge 25 cuts through the unburnt tobacco until it reaches the cutting groove 51. The snuffer 26 moves in the same direction as the blade 24, trailing the blade sharp edge 25, and against the burning and unburnt tobacco that is behind the cutting groove 51, snuffing the burning tobacco so that it is extinguished. FIG. 9 shows the blade and snuffer plunger 18 in the closed position. The burning tobacco, and a very small amount of unburnt tobacco, have been cut from the cigarette, and crushed between the snuffer 26 and the snuffer stop 16, causing the burnt tobacco to be completely extinguished. The smoker then releases the blade and snuffer plunger 18, which returns to the retracted position seen in FIG. 9. The smoker can then remove the butt and smoke it at a later time.

The present invention provides a device which neatly cuts and completely separates the burning tobacco from a cigarette, and leaves the end of the resulting butt neatly cut and without burnt tobacco. The snuffer of the invention immediately and completely snuffs the burning tobacco cut from the cigarette, eliminating the smoke that would otherwise be produced if the smoker had separated the burning tobacco from the cigarette without snuffing it.

While the above description contains many specificities, these should not be construed as limitations on the scope of the invention, but rather as an exemplification of one preferred embodiment thereof. Many other variations are possible. For example, an electrical solenoid, triggered by a sensing switch, could be used to actuate the plunger. Another variation would not have the cigarette tray 12 for applications in which it is unnecessary or inconvenient.

What is claimed is:

1. A device for reconditioning a partially smoked cigarette by cutting off and snuffing the burning end of a cigarette to leave a butt for re-smoking, said device comprising:

(a) a housing having walls enclosing a chamber, and openings in said chamber for insertion of said burning end of a cigarette into said chamber, (b) a plunger reciprocally movable in a movement direction in said housing across said chamber, said plunger having a blade and a snuffer protruding from the plunger in a direction perpendicular to said movement direction, the snuffer having a snuffing surface perpendicular to said blade which engages said burning end of said cigarette and cuts and snuffs said cigarette end while moving across said chamber, thereby leaving said butt in a condition suitable for smoking.

2. The device according to claim 1 wherein the chamber has a fixed flat surface opposing said snuffing surface which cooperates with the snuffing surface to snuff the burning tobacco cut from the end of a cigarette and defines a stop for the snuffing surface.

3. The device according to claim 1 wherein said plunger and blade define a guillotine to cut burning tobacco from the end of a cigarette.

4. The device according to claim 2 wherein the fixed surface is defined by a flange extending from the back end of the housing.

5. The device according to claim 1 wherein the housing defines a tray that holds the cigarette in place during and after cutting and snuffing.

6. The device according to claim 1 wherein the blade and plunger are an assembly, made of a stiff metal, with the blade attached to the plunger such that the sharp edge of the blade extends past the lower end of the plunger.

7. The device according to claim 1, further comprising a spring attached to the plunger and positioned between the end of the plunger and the housing which biases the plunger away from the housing to a retracted position of the plunger.

* * * * *